United States Patent [19]

Rose

[11] Patent Number: 4,497,236

[45] Date of Patent: Feb. 5, 1985

[54] APPARATUS FOR RESTRAINING AND FINE TUNING THE STRINGS OF A MUSICAL INSTRUMENT, PARTICULARLY GUITARS

[76] Inventor: Floyd D. Rose, 2727 NE. 145th, Seattle, Wash. 98155

[21] Appl. No.: 358,169

[22] Filed: Mar. 15, 1982

[51] Int. Cl.[3] ..... G10D 3/04; G10D 3/14

[52] U.S. Cl. ..... 84/298; 84/297 R; 84/312 R; 84/313

[58] Field of Search ..... 84/298, 299, 314 N, 84/297 R, 267, 307, 312, 313

[56] References Cited

U.S. PATENT DOCUMENTS

| | | | |
|---|---|---|---|
| 2,741,146 | 4/1956 | Fender | 84/313 |
| 2,969,703 | 1/1961 | Matteo | 84/299 |
| 3,396,284 | 8/1968 | Scherer | 84/313 X |
| 3,407,696 | 10/1968 | Smith et al. | 84/297 R |
| 3,479,917 | 11/1969 | Zitnik et al. | 84/312 R |
| 4,141,271 | 2/1979 | Mullen | 84/312 P |
| 4,171,661 | 10/1979 | Rose | 84/313 |
| 4,354,417 | 10/1982 | Glaser | 84/312 R |

*Primary Examiner*—Lawrence R. Franklin
*Attorney, Agent, or Firm*—Cole, Jensen & Puntigam

[57] ABSTRACT

The fine tuning apparatus functions as the bridge element (20) of a stringed instrument. The fine tuning apparatus includes a base element (22) and a series of fine tuning elements (40), one for each string. Each fine tuning element (40) includes a forward block element (42) and a rear block element (52) which is rotatable relative to the forward block element. A string of the musical instrument makes critical contact with the fine tuning apparatus at point (59) on the rear block element (52) and maintains surface contact with the rear block element (52) as the surface slopes downwardly and rearwardly from the bridge critical contact point (59), until the point where the string is clamped against surface (60). Means (64, 70) are provided for adjusting the rotatable position of the rear block element (52) relative to the forward block element (42), which results in a change in the tension of the string and hence the fine tune of the string.

28 Claims, 4 Drawing Figures

FIG. 1
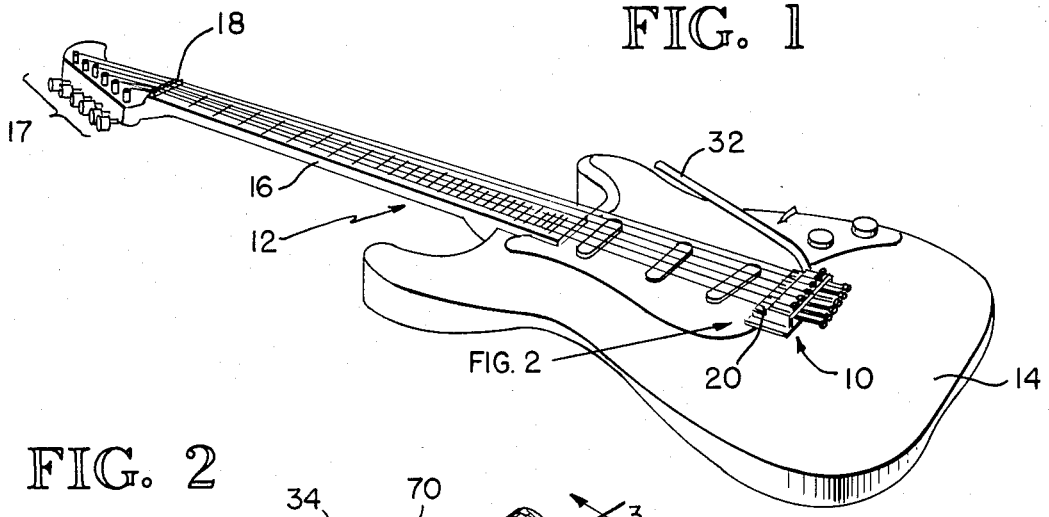
FIG. 2
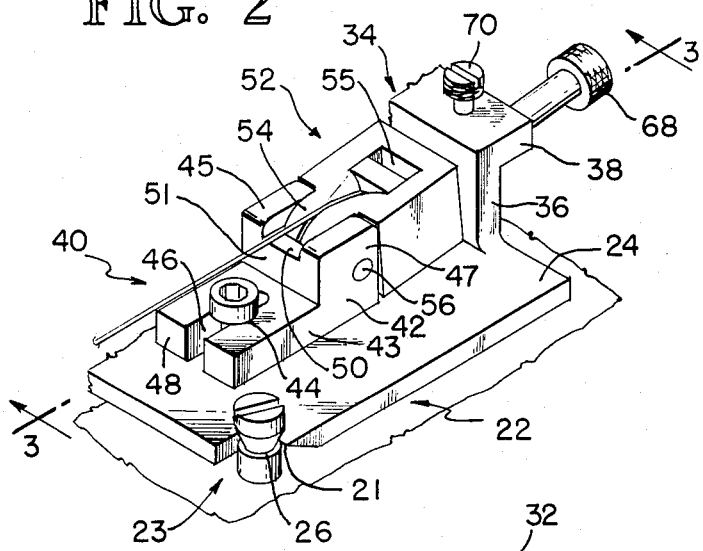
FIG. 4
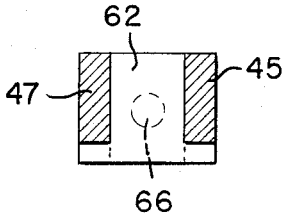
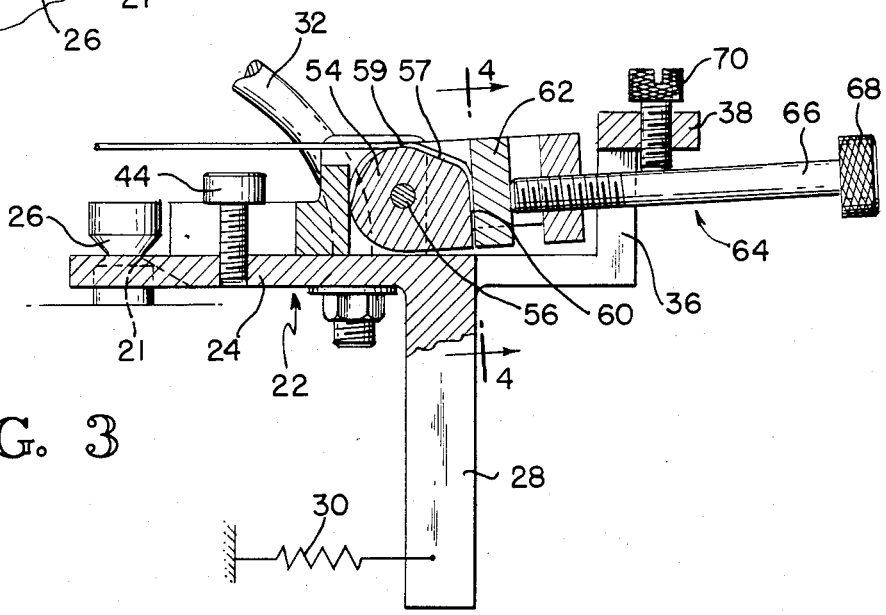
FIG. 3

APPARATUS FOR RESTRAINING AND FINE TUNING THE STRINGS OF A MUSICAL INSTRUMENT, PARTICULARLY GUITARS

DESCRIPTION

Technical Field

This invention relates generally to apparatus for fine tuning stringed musical instruments, and more particularly concerns apparatus which is mounted on the musical instrument and functions as the bridge or nut for the instrument but which also is capable of fine tuning the strings of the instrument while simultaneously restraining them securely.

Background Art

It is known to those skilled in the guitar art that there are two types of string tuning. One type of tuning is referred to as pitch or fine tuning, which is accomplished by increasing or decreasing the tension on a given string by means of tuning keys or the like, thereby raising or lowering, respectively, the pitch of the string. The other type of string tuning is referred to as harmonic or string length tuning, which is accomplished by altering the distance between the points at which a given string contacts the bridge and nut elements of the instrument.

It is also known that clamping devices incorporated at the bridge and nut of the instrument greatly increase the length of time an instrument will remain pitched tuned. Further, clamping devices are known to be particularly useful when used with a tremolo or vibrato device. One example of such a clamping system is shown in U.S. Pat. No. 4,171,661, issued on Oct. 23, 1979, to Floyd Rose, the named inventor herein. It is, however, inconvenient to pitch tune guitars or other stringed musical instruments equipped with clamping devices. Initially, when the clamps are tightened for a given string, the string will slightly distort, causing a slight change in the existing pitch tuning. To readjust the pitch tuning, the clamps must first be loosened, the string pitch tuned again, and the clamps retightened. This procedure must be repeated until all the strings on the instrument are properly pitch tuned with the clamps tightened.

Accordingly, it is a general object of the present invention to provide a fine tuning apparatus which is mounted on the instrument and which overcomes one or more of the disadvantages of the prior art mentioned above.

It is another object of the present invention to provide such an apparatus by which the instrument strings can be fine tuned while the strings are clamped.

It is an additional object of the present invention to provide such an apparatus which in operation causes minimal longitudinal motion, and hence minimal drag, of the string relative to the bridge and nut contact points.

It is a further object of the present invention to provide such an apparatus which is designed and constructed so there is a minimal distance between the initial contact point of the string on the apparatus and the point where the string is clamped.

It is yet another object of the present invention to provide such an apparatus which in operation does not affect the harmonic tune of the string.

DISCLOSURE OF THE INVENTION

Accordingly, the invention is an apparatus for fine tuning a stringed musical instrument, wherein each string makes a first critical contact with the instrument at a point on the nut of the instrument and a second critical contact with the instrument at a point on the bridge of the instrument. The apparatus includes string support means which is mounted on the guitar, at such a location that one of the first and second critical contact points for the strings of the instrument is on the string support means. The apparatus also includes means associated with the string support means for securely holding the string. Further, the apparatus includes means for moving both the string support means and the holding means in such a manner as to change the tension of the string, and hence fine tune the string, while the string is securely held by the holding means, and essentially without changing the distance between the string's first and second critical contact points, so that the harmonic tune of the instrument remains essentially the same.

BRIEF DESCRIPTION OF THE DRAWINGS

FIG. 1 is a schematic view showing the apparatus of the present invention in position on an electric guitar.

FIG. 2 is a schematic view of the fine tuning apparatus of the present invention, as adapted for use as the bridge element of the instrument.

FIG. 3 is a cross-sectional view taken along lines 3—3 in FIG. 2.

FIG. 4 is a cross-sectional view taken along lines 4—4 in FIG. 3.

BEST MODE FOR CARRYING OUT THE INVENTION

FIG. 1 shows the apparatus of the present invention, shown generally at 10, as the bridge element 20 of an electric guitar 12. The guitar 12 comprises generally a body 14 and a neck 16. Near the top of neck 16 is the nut element 18, and beyond that are several tuning pegs 17, one for each string. On the body of the guitar 12 is the bridge element 20. The present fine tuning invention incorporates the function of a bridge element in its structure, as well as structure for securely clamping the individual strings.

Although the present invention is shown in use on an electric guitar, it should be understood that the invention can be used on other stringed instruments, including, for example the cello, banjo, and even the piano. The invention will probably have its greatest use, however, on a guitar and hence is so described. Further, although the present invention is described and shown as a guitar bridge element, it should be understood that the invention could be adapted for use as the nut element of the guitar as well.

As mentioned above, guitar strings are both harmonically tuned and pitch tuned. The harmonic tune of the strings may be changed by changing the distance between the last contact point of the string on the nut, i.e. the contact point nearest the bridge, and the first contact point on the bridge, i.e. the contact point nearest the nut. These are referred to hereinafter as the critical contact points of the instrument's strings. Harmonic tuning may be accomplished, for example, by moving the bridge or the critical contact point of the string on the bridge longitudinally relative to the nut. Harmonic tuning per se of an instrument is not the subject of the present invention, although the invention has been designed so that the harmonic tuning of the instrument is maintained while pitch fine tuning is accomplished. Also, harmonic tuning can be accomplished with the structure shown and described.

The strings are pitch or fine tuned by changing the tension of the strings. Ideally, this should be done without changing the distance between the nut and bridge critical contact points. The present invention, as shown and described, is capable of such a result. Increasing the tension of the string raises the pitch of the string, while decreasing the string's tension lowers the string's pitch. The structure for changing the tension of a string, essentially without changing the distance between the critical contact points at the bridge and nut, forms the subject matter of the present invention. Also, the invention has been designed so as to minimize the length of string between the critical contact point thereon and the point where the string is clamped, although the string length could in fact vary from that shown and still be within the spirit of the present invention.

FIGS. 2 and 3 show the present invention in more detail. Referring specifically to those figures, the invention is shown in use with a tremolo apparatus, in the operation of which the bridge is tilted relative to the body of the guitar to momentarily significantly change the pitch of the guitar strings. The embodiment of FIG. 2 includes a tremolo base element shown generally at 22, a primary part of which is a flat plate 24 which is generally aligned parallel to the top surface of the guitar. Flat plate 24 includes a knife edge section 21 at each of its forward corners 23. The knife edge sections mate with a tapered groove in an upstanding position screw 26 which is fixed to the body of the guitar. At the rear of flat plate 24 a flange 28 extends downwardly into a cavity in the body of the guitar. Connecting the bottom of the flange 28 with the body of the guitar is a horizontal spring or springs 30.

A tremolo bar 32 is secured to flat plate 24 near one longitudinal edge thereof (the right edge in FIG. 1, looking toward the neck of the guitar). When tremolo bar 32 is moved towards the body of the guitar, tremolo base element 22 tilts upwardly against the action of springs 30 about the two fixed position screws. This action significantly changes the original pitch tune of the instrument and facilitates an increased range of sounds for the instrument. When the original pitch tune is again desired, tremolo bar 32 is released and the springs 30 return the tremolo base element 22 to its original position, which returns the bridge structure and the strings to their original position. It should be understood, however, that even though the invention is shown in use with a tremolo device, it is not necessary that a tremolo device be present. The tremolo base element 22 could either be affixed to the body of the guitar, or in some instances may not be present at all.

Referring again to FIGS. 2 and 3, tremolo base element 22 further includes an upstanding L-shaped flange shown generally at 34 which extends upwardly from the rear edge of flat plate 24 and which has a width which is somewhat greater than the distance between the two outside strings on the instrument, i.e. the high E and low E strings, so that the flange 34 is slightly wider than the set of strings. In the embodiment shown, flange 34 is approximately 2 9/16 inches wide. The vertical portion 36 of flange 34 is approximately 7/16 inches high, while the horizontal portion 38 extends rearwardly a distance of approximately $\frac{1}{8}$ inch from portion 36. The flange 34 is approximately $\frac{1}{8}$ inch thick and in the embodiment shown is chromed and case-hardened steel, as is flat plate 24.

Although the tremolo base element 22, including the L-shaped flange 34, forms a single unit in the embodiment shown, each of the strings has a separate fine tuning/bridge/clamping apparatus, referred to hereinafter as a fine tuning element, which is independent of the fine tuning elements for the other strings. All of the fine tuning elements, however, are mounted on base element 22. One such fine tuning element is shown in FIGS. 2, 3 and 4. The fine tuning element shown generally at 40 includes a forward block element shown generally at 42 and a rear block element 52.

Forward block element 42 includes a front plate-like section 43, approximately 5/32 inch thick, which has a slot 46 which extends from the front edge 48 thereof rearward for a distance of approximately $\frac{3}{8}$ inch. Slot 46 extends through the entire thickness of plate-like section 43, and is located approximately at a mid-width point thereof. Slot 46 is wide enough to accommodate a machine screw 44, which is threaded into flat plate 24, and which clamps the forward block element 42 against plate 24. Loosening machine screw 44 permits longitudinal movement of forward block element 42, rear block element 52, and associated parts, for harmonic tuning of the strings.

The rear section of forward block element 42 extends above the front plate-like section, but is cut out so that it is U-shaped when viewed from above, open in the rearward direction. The rear section thus comprises two edge portions 45, 47 joined at their forward ends by an intermediate portion 51. The top edge of the intermediate portion 51 is slightly relieved at 50.

The rear block element 52 of the fine tuning element is basically square in three dimensional outline, with a semi-circular vertical ear portion 54 extending from the front surface thereof. Ear portion 54 is approximately the same width as the distance between the two edge portions 45, 47 of the rear section of forward block element 42, while the full width of rear block element 52 is approximately equal to the distance between the exterior surfaces of edge portions 45, 47.

A circular opening is provided through the two edge portions 45, 47, as well as ear portion 54 of rear block element 52. A pin 56 is positioned in the opening, and the front and rear surfaces, respectively, of rear block element 52 and forward block element 42 are configured so that rear block element 52 is rotatable relative to forward block element 42 about pin 56.

The rear block element 52 also includes a central opening 55 therein which opens onto both the top surface and the bottom surface. The interior surface defining the front or forward configuration of the central opening 55 may be radiused in such a manner as to continue the curve of the semi-circular ear portion 54 a given distance into the opening, or it may be flat, but angled downwardly.

FIG. 3 shows a relatively flat surface 57, angled downwardly from the curved portion of ear portion 54, relative to the axis of rotation about pin 56. Surface 57 extends a short distance rearwardly of the axis of rotation and terminates in a vertical flat surface 60, which extends downwardly to the lower surface of rear block 52. The portion of ear 54, surface 57 and flat surface 60 which the string contacts is referred to as the string contact surface. The first part or all of surface 57 could be curved, as well. The string makes initial contact at the top dead center point 59. The string contact surface to the front and rear of point 59 should be curved a sufficient distance, referred to as the critical distance, to permit the range of fine tuning desired, i.e. as rear block element rotates to accomplish the fine tuning, as clarified hereinafter, the critical contact point of the string will always be on a curved portion of the string contact surface.

Flat surface 57 or an increasing radius portion to the rear of the critical distance portion results in an increased rearward thickness between pin 56 and surface 60. This increased thickness is helpful to the tuning element in withstanding a clamping action, as explained hereinafter. If section 57 is gently curved, the life of the string will be increased. The other interior surfaces defining opening 55 are in the embodiment shown vertical and flat, although their configuration is not particularly significant. The rear block element 52 terminates a relatively short distance from the L-shaped flange 34 at the rear of plate 24.

Positioned within opening 55 is a front plate portion 62 of a string clamp shown generally at 64 (FIG. 3). The instrument string is positioned down through opening 55 between surface 60 and the front plate 62. The critical contact point between the string and the rear block 52 occurs in the vicinity of the top dead center of the axis of rotation, i.e. approximately at point 59 in FIG. 3. Thus, the fine tuning element also functions as a bridge for the string.

In the embodiment shown, the string is held fast between surface 60 and front plate 62 and then proceeds upwardly and forwardly, following surface 57 until point 59, which is the bridge critical contact point. The string is of course free between the bridge critical contact point and the nut critical contact point at the neck of the instrument.

The forward end of a threaded shank 66 bears against the front plate 62. Threaded shank 66 is threaded through the rear wall of rear block element 52, and then extends through a vertical slot in the vertical portion 36 of the L-shaped flange 34. The threaded portion of the shank terminates approximately ¼ inch from the end. In the embodiment shown, shank 66 terminates approximately ½ inch to the rear of the back surface of vertical portion 36 of the L-shaped flange 34 in a head 68, which may be turned by means of an Allen wrench in the embodiment shown to change the pressure against front plate 62 and clamp/unclamp the string. Clamp 64 is a conventional and efficient means for quickly clamping and releasing the strings. Thus, the device of the present invention, in the embodiment shown, includes an efficient string clamp means, wherein the clamping point is a very short distance from the bridge critical contact point 59.

A fine tuning adjustment screw 70 is threaded through the horizontal portion 38 of the L-shaped flange 34 and positioned so that it will contact the non-threaded portion of threaded shank 66. Shank 66 and hence rear block element 52 are free to move a short distance vertically, because shank 66 is in the vertical slot in portion 36 of the L-shaped flange. Threaded shank 66 is biased vertically against the bottom of adjustment screw 70 by the action of the tension of the instrument string itself. The actual vertical position of threaded shank 66 and hence the rotational position of rear block element 52 is determined by the position of adjustment screw 70. Screw 70 may be conveniently rotated by hand or a conventional screwdriver. Threading screw 70 downwardly pushes threaded shank 66 downwardly and rotates rear block element 52 clockwise (FIG. 3). Threading screw 70 upwardly results in an upward movement of threaded shank 66 and a counterclockwise rotation of rear block element 52.

If the tension on a given string is to be changed, i.e. if the string is to be fine tuned, adjustment screw 70 is moved clockwise (moving downwardly) to increase the string tension and hence string pitch, and counterclockwise (moving upwardly) to decrease the string tension and hence string pitch. As the rear block element 52 rotates about pin 56, the critical point of bridge contact of the string remains approximately at point 59, due to the radiused top portion of rear block element 52 and ear 54. Hence, the distance between the bridge critical contact point and the nut critical contact remains the same during the fine tuning of the string, while the string remains clamped, thus maintaining the harmonic tuning of the string.

The present invention has the further advantage that the clamping point for the string is very close to the bridge critical contact point 59. Hence, there is very little movement of the string over the critical contact point, and hence very little drag developed between the bridge contact point and the string, since the tensioning effect on the string by increasing/decreasing the tension will be substantially completely absorbed by tht portion of the string between the nut and bridge critical contact points. There is hence very little pitch distortion with the use of this invention.

The present invention thus results in a significantly improved pitch tuning capability. Further, when the invention is used with a tremolo, the strings will come back into their original harmonic and pitch or fine tune when the tremolo is returned to its normal position. Thus, the present invention results in a stringed instrument which is capable of staying in tune for an extended length of time. This is a distinct advantage over prior art systems. Further, it has been found with the embodiment shown that string life is significantly increased.

Although a preferred embodiment of the invention has been disclosed herein for purposes of illustration, it should be understood that various changes, modifications and substitutions may be incorporated in such embodiment without departing from the spirit of the invention, as defined by the claims which follow.

I claim:

1. An apparatus for tuning a stringed musical instrument, wherein each string makes a first critical contact with the instrument at a point on the nut of the instrument and a second critical contact at a point on the bridge of the instrument, the apparatus comprising:

string support means for each string, said string support means including thereon the second critical contact point for each string;

means in the vicinity of said string support means for securely holding each string;

means for moving said string support means so as to change the distance between the first and second critical contact points of said strings, thereby changing the harmonic tuning thereof; and means for moving said string holding means and also said string support means in such a manner as to change the tension in the string so as to fine tune the strings individually but not change the harmonic tuning thereof, while the string is securely held and essentially without changing the distance between the first and second critical contact points of the string.

2. An apparatus of claim 1, including a separate string support means for each string, independent of the other string support means.

3. An apparatus of claim 1, wherein there is substantially continuous contact between the string and the string support means over the distance between said second critical contact point and the point where the string is held.

4. An apparatus of claim 3, wherein the distance between said second critical contact point and the point where the string is held is small.

5. An apparatus of claim 4, wherein at least a portion of said string support means and said string holding means rotate together about a fixed axis.

6. An apparatus of claim 5, wherein said string support means includes a first, forward block and a second, rear block, the second block being mounted so as to be rotatable relative to the first block, the second block including a string contact surface which includes thereon said second critical contact point and the location where the string is held.

7. An apparatus of claim 6, wherein said second critical contact point is at the top dead center of an imaginary circle having the fixed axis as the center point thereof.

8. An apparatus of claims 7 or 3, wherein the string contact surface on the string support means to the rear of the second critical contact point slopes rearwardly and downwardly and that surface on the string support means to the front of the second critical contact point slopes downwardly and forwardly therefrom.

9. An apparatus of claim 8, wherein said surfaces to the front and rear of the second critical contact point are curved.

10. An apparatus of claim 9, wherein said surfaces to the front and rear of the second critical contact point have a radius of curvature which remains substantially the same over a critical distance sufficient to provide a desired range of fine-tuning for the string.

11. An apparatus of claim 10, wherein said surface to the rear of the second critical contact point beyond the boundary of the critical distance has an increasing radius.

12. An apparatus of claim 6, including means for adjusting the rotational position of the second block, which results in a change in the tension of the string, essentially without changing the distance between the first and second critical contact points.

13. An apparatus of claim 12, wherein said adjusting means includes a first adjusting element which extends rearwardly of the second block and is connected thereto, and a second adjusting element for changing the vertical position of said first adjusting element and hence the rotational position of said second block relative to the first block.

14. An apparatus of claim 13, wherein said first adjusting element includes a shank and a plate at the forward end thereof for clamping the string against at least a portion of the string contact surface on the second block.

15. An apparatus of claim 13, wherein said second adjusting element can be operated by hand.

16. A tremolo and tuning apparatus for use on a stringed musical instrument, wherein each string makes a first critical contact with the instrument at a point on the nut of the instrument and a second critical contact at a point on the bridge of the instrument, the apparatus comprising:

means for moving the second critical contact point of each string individually so as to change the distance between the first and second critical contact points of said each string, thereby changing the harmonic tuning thereof;

tremolo means for simultaneously changing the pitch of all the strings of the instrument; and means mounted on said tremolo means, and hence movable therewith, for fine tuning each string individually by changing the tension thereof, essentially without changing the distance between the first and second critical contact points thereof.

17. An apparatus of claim 16, including a fine tuning means for each string of the instrument, each fine tuning means being separately mounted on said tremolo means.

18. An apparatus of claim 17, wherein said tremolo means includes a tremolo base plate and a tremolo bar attached to said base plate, wherein when said tremolo bar is operated in a first direction toward the body of the instrument, a significant decrease in the tension of the strings of the instrument occurs.

19. An apparatus of claim 18, wherein said tremolo means is arranged such that when said tremolo bar is operated in a second direction away from the body of the guitar, the tension on the strings of the instrument is increased.

20. An apparatus of claim 17, wherein each fine tuning means includes a first, forward block and a second, rear block, the second block being mounted so as to be rotatable relative to the first block, the second block including a string contact surface which includes thereon said second critical contact point, the first and second blocks being movable as a unit to change the distance between said first and second critical contact points.

21. An apparatus of claim 20, wherein the string contact surfaces to the front and rear of said second critical contact point have a radius of curvature which remains substantially the same over a critical distance sufficient to provide a desired range of fine tuning for the string.

22. An apparatus of claim 21, including means for adjusting the rotational position of the second block, which results in a change in the tension of the string, without changing the distance between the first and second critical contact points.

23. An apparatus of claim 16, wherein said fine tuning means includes means for securely holding at least one of the strings of the instrument.

24. An apparatus of claim 23, wherein said securely holding means includes means for securely holding all of the strings of the instrument.

25. An apparatus of claim 23, wherein said securely holding means includes means for clamping the strings.

26. An apparatus of claim 23, wherein said tremolo means includes (a) a base portion mounted relative to the instrument so that it rotates about a lateral axis relative to the strings of the instrument, (b) means urging said base portion into a first position relative to the instrument, in which position said tremolo means is not operated, and (c) means for moving said base portion away from first position against the action of said urging means, thereby changing the pitch of the strings of the instrument simultaneously, wherein said fine tuning means is mounted on said base portion of said tremolo means and rotates therewith.

27. An apparatus of claim 16, wherein said fine tuning means includes thereon the second critical contact point.

28. An apparatus of claim 16 including a means in the vicinity of the nut for securely holding the strings of the instrument.

* * * * *